US010767326B2

(12) United States Patent
Yuan et al.

(10) Patent No.: US 10,767,326 B2
(45) Date of Patent: Sep. 8, 2020

(54) AUGER FOR A SNOW THROWER

(71) Applicant: Nanjing Chervon Industry Co., Ltd., Nanjing (CN)

(72) Inventors: Feng Yuan, Nanjing (CN); Toshinari Yamaoka, Nanjing (CN); Fangjie Nie, Nanjing (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 227 days.

(21) Appl. No.: 15/955,980

(22) Filed: Apr. 18, 2018

(65) Prior Publication Data

US 2018/0334781 A1 Nov. 22, 2018

(30) Foreign Application Priority Data

May 16, 2017 (CN) ..... 2017 2 0545696 U

(51) Int. Cl.
*E01H 5/04* (2006.01)
*E01H 5/09* (2006.01)

(52) U.S. Cl.
CPC ..... *E01H 5/045* (2013.01); *E01H 5/098* (2013.01)

(58) Field of Classification Search
CPC ..... E01H 5/048; E01H 5/098; E01H 5/065; E01H 5/08; E01H 5/09
See application file for complete search history.

(56) References Cited

U.S. PATENT DOCUMENTS 3,913,247 A * 10/1975 Ruhl ..... E01H 5/04 37/258
4,203,237 A * 5/1980 Enters ..... E01H 5/04 198/659
4,322,896 A * 4/1982 Miyazawa ..... E01H 5/04 37/233
D307,912 S * 5/1990 Yoshida ..... D15/12
D314,775 S * 2/1991 Yoshida ..... D15/11
5,398,431 A * 3/1995 Beihoffer ..... E01H 5/04 37/247
5,758,436 A * 6/1998 Harms ..... E01H 5/04 37/249
6,327,798 B1 * 12/2001 Sakai ..... E01H 5/04 37/249
7,472,500 B2 * 1/2009 White, III ..... E01H 5/045 292/336.3
7,624,521 B2 * 12/2009 White, III ..... E01H 5/045 180/19.3
D675,232 S * 1/2013 Martin ..... D15/12
(Continued)

*Primary Examiner* — Jamie L McGowan
(74) *Attorney, Agent, or Firm* — Greenberg Traurig, LLP

(57) ABSTRACT

A snow thrower and an auger. The snow thrower includes the auger. The auger includes a supporting shaft having a central axis, a snow throwing bracket configured to throw snow, a left snow scraper configured to push snow to the right towards a region where the snow throwing bracket is located, a right snow scraper configured to push snow to the left towards the region where the snow throwing bracket is located, a left supporting plate secured to a left end of the supporting shaft, and a right supporting plate secured to a right end of the supporting shaft. The left snow scraper and the right snow scraper are symmetrical about a plane perpendicular to the central axis. An angle of the left snow scraper around the central axis is greater than 180 degrees and smaller than 360 degrees.

18 Claims, 8 Drawing Sheets

(56) References Cited

U.S. PATENT DOCUMENTS

| | | | | |
|---|---|---|---|---|
| 9,309,638 | B2 * | 4/2016 | Gilpatrick | E01H 5/045 |
| 9,546,462 | B2 * | 1/2017 | Friberg | E01H 6/00 |
| 9,863,107 | B2 * | 1/2018 | Friberg | E01H 6/00 |
| 2002/0020083 | A1 * | 2/2002 | White, III | E01H 5/062 37/244 |
| 2010/0037492 | A1 * | 2/2010 | Manion | E01H 4/023 37/219 |

* cited by examiner

AUGER FOR A SNOW THROWER

CROSS-REFERENCES TO RELATED APPLICATIONS

This application claims priority to Chinese patent application No. CN201720545696.5, filed on Mar. 16, 2017, the disclosure of which is incorporated herein by reference in its entirety.

TECHNICAL FIELD

The present disclosure relates to a snow thrower and an auger thereof.

BACKGROUND

As a hand-push type power tool, the snow thrower is an important device for clearing snow in winter. The snow thrower has major advantages of high efficiency, economy, environmental protection and the like. With the growing economy and the continuous progress of society, the snow thrower is also gradually popularized at home and abroad.

The snow thrower includes an auger and a snow throwing cylinder. For a traditional snow thrower, part of the snow is directly thrown to the snow throwing cylinder when the auger rotates. Apparently, most of snow cannot be thrown exactly to the snow throwing cylinder. Thus, snow clearing efficiency is low.

SUMMARY

An auger for use in a snow thrower includes a supporting shaft having a central axis, a snow throwing bracket secured to a middle portion of the supporting shaft and configured to throw snow, a left snow scraper surrounding the supporting shaft, secured to a left end of the snow throwing bracket and configured to push the snow to the right towards a region where the snow throwing bracket is located, a right snow scraper surrounding the supporting shaft, secured to a right end of the snow throwing bracket and configured to push the snow to the left towards the region where the snow throwing bracket is located, a left supporting plate secured to a left end of the supporting shaft, two ends of which are respectively secured to the snow throwing bracket and the left supporting plate, and a right supporting plate secured to a right end of the supporting shaft, two ends of which are respectively secured to the snow throwing bracket and the right supporting plate. The left snow scraper and the right snow scraper are symmetrical about a plane perpendicular to the central axis. An angle of the left snow scraper around the central axis is greater than 180 degrees and smaller than 360 degrees, and a ratio of the angle of the left snow scraper around the central axis to a length of the left snow scraper in a direction of the central axis is greater than or equal to 0.9 degree/mm and less than or equal to 3 degree/mm.

Further, the angle of the left snow scraper around the central axis may be greater than 210 degrees and smaller than 270 degrees and the ratio of the angle of the left snow scraper around the central axis to the length of the left snow scraper in the direction of the central axis may be greater than or equal to 1 degree/mm and less than or equal to 2.2 degree/mm.

Further, the auger may include two left snow scrapers and two right snow scrapers. The two left snow scrapers are respectively secured to two ends of the left supporting plate and the two right snow scrapers are respectively secured to two ends of the right supporting plate.

Further, the snow throwing bracket may be made of a first material, and the auger may further include an edge plate made of a second material which has a smaller hardness than the first material. The edge plate may be secured to an edge of the snow throwing bracket and the edge plate may protrude from the edge of the snow throwing bracket in a radial direction of the central axis.

Further, the snow throwing bracket may be provided with a through hole, and the through hole may be located between the edge plate and the supporting shaft.

Further, a hardness of the left snow scraper may be greater than or equal to 50 HRB and less than or equal to 100 HRB, and a thickness of the left snow scraper may be greater than or equal to 1.5 mm and less than or equal to 3.5 mm.

Further, an outer side of the left snow scraper away from the central axis may be provided with sawteeth.

Further, the auger may include a left auxiliary supporting plate located between the snow throwing bracket and the left supporting plate. The left auxiliary supporting plate may be secured to the supporting shaft, and the middle portion of the left snow scraper may be secured to one end of the left auxiliary supporting plate.

Further, the left snow scraper may be provided with a protruding rib protruding from a surface of the left snow scraper facing the snow throwing bracket. The rear side of the left snow scraper may be provided with a groove corresponding to the protruding rib.

Further, the auger may be made of metal material.

Also described is a snow thrower that includes an auger housing formed with an accommodating cavity and a one of the above augers which is arranged in the accommodating cavity.

The present disclosure has the following beneficial effects: snow can be rapidly gathered from both sides to the middle when the auger of the snow thrower is rotating, thereby increasing the snow clearing efficiency; and the snow is prevented from being scattered when the auger is throwing the snow, thereby improving the snow clearing effect.

DETAILED DESCRIPTION

The present disclosure is described in detail below in conjunction with accompanying drawings and specific examples.

Figure 1:
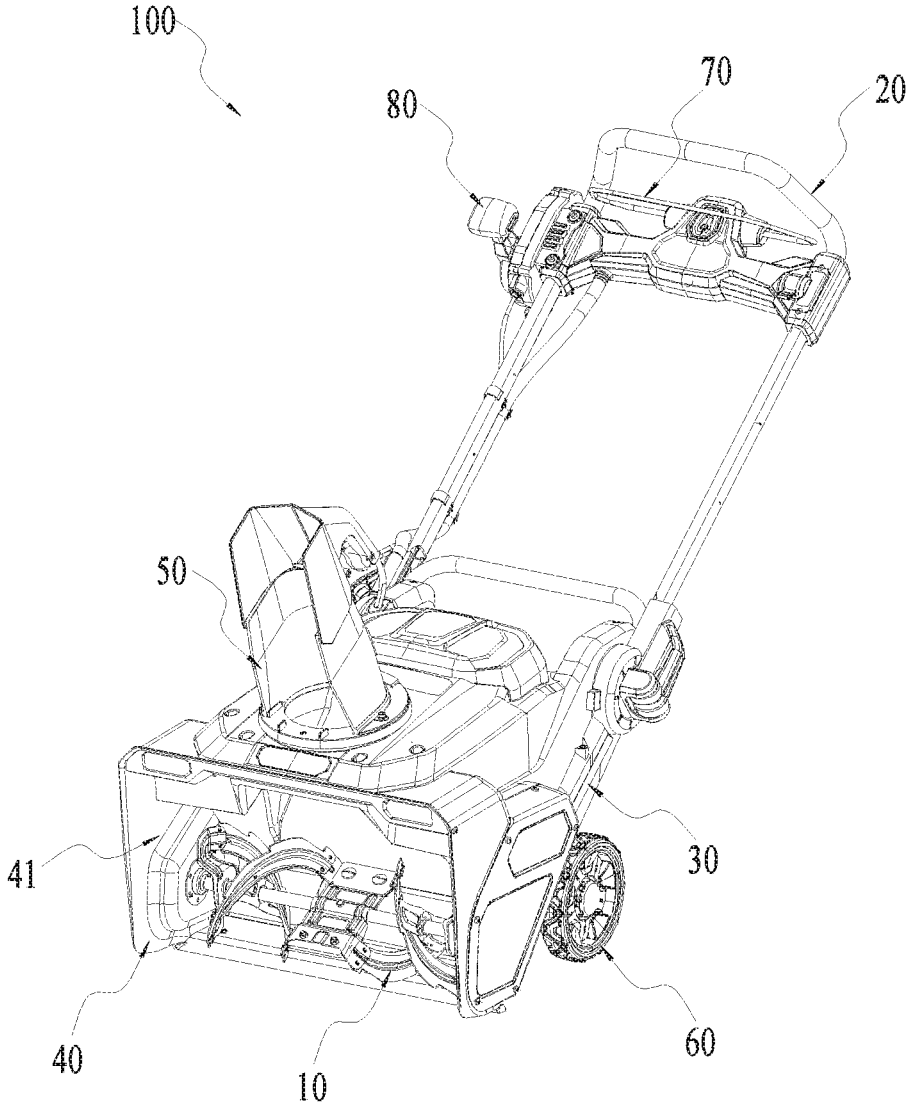
FIG. 1 is a perspective view of an exemplary snow thrower.
Figure 2:
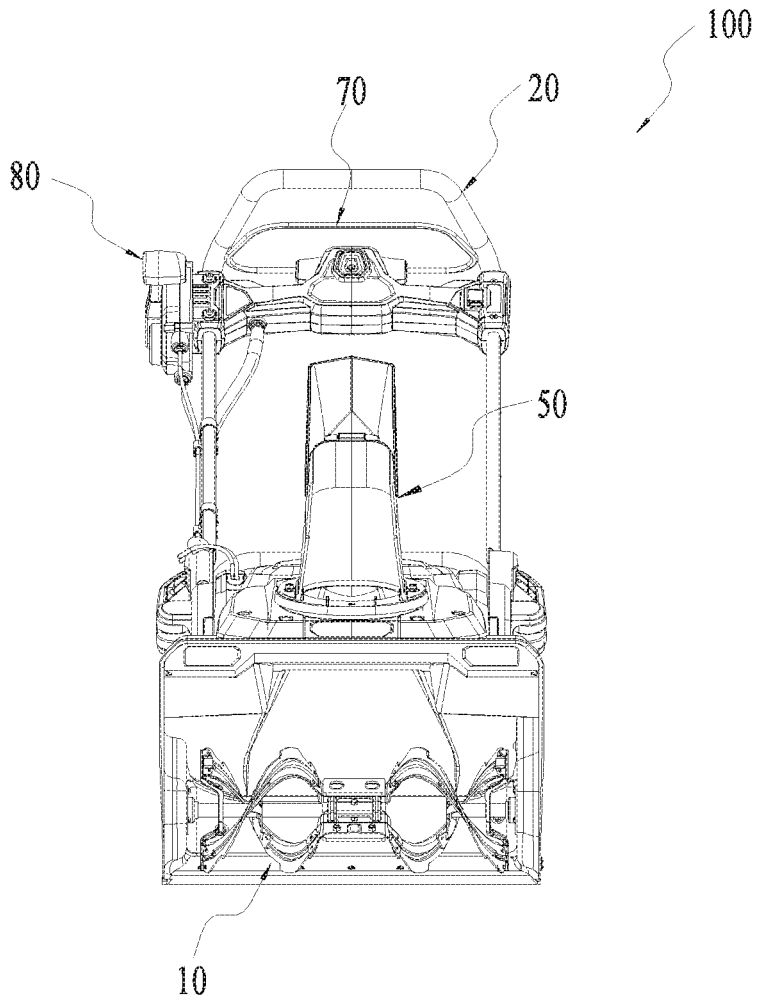
FIG. 2 is a plan view of the snow thrower in FIG. 1.
Figure 3:
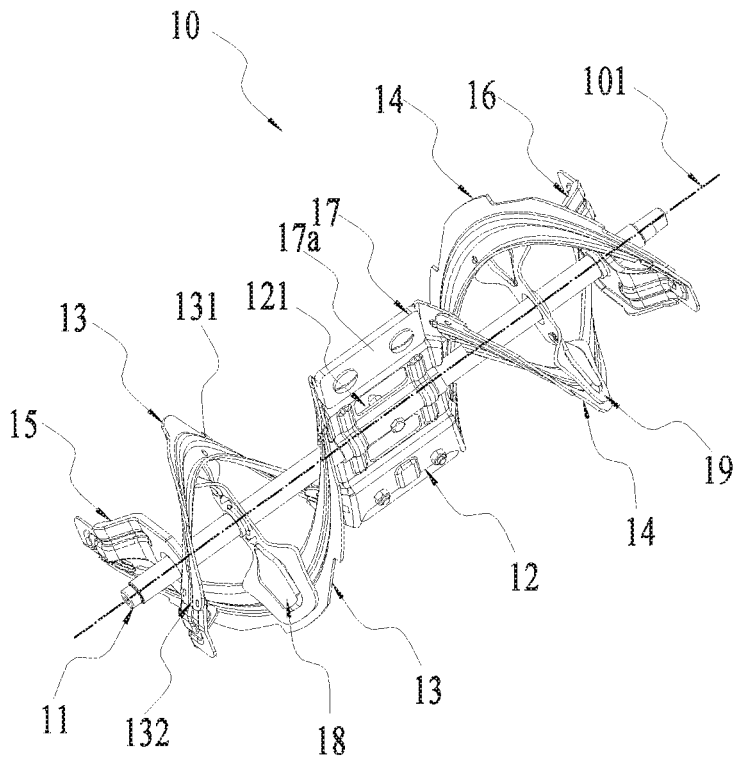
FIG. 3 is a perspective view of an auger of the snow thrower in FIG. 1.
Figure 4:
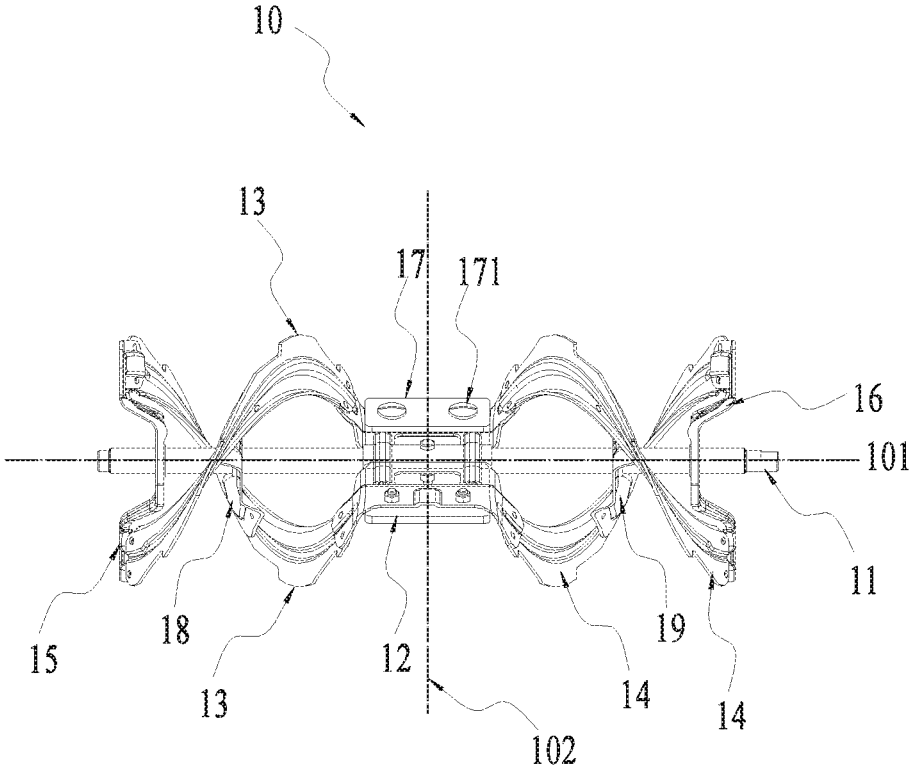
FIG. 4 is a plan view of the auger in FIG. 3.
Figure 5:
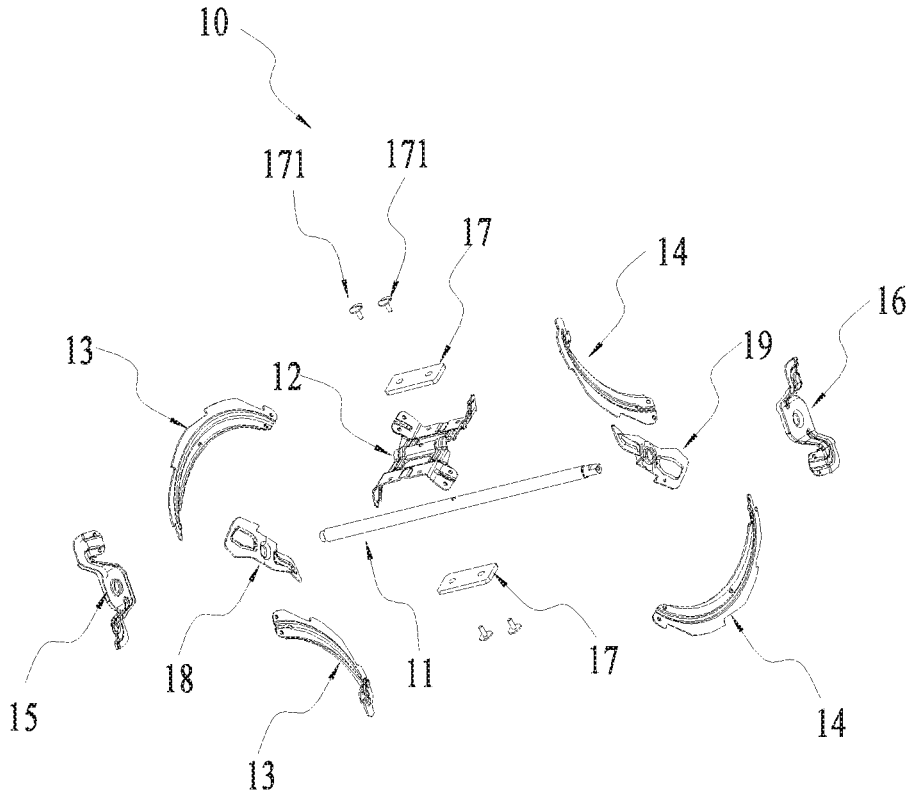
FIG. 5 is an exploded view of the auger in FIG. 3.
Figure 6:
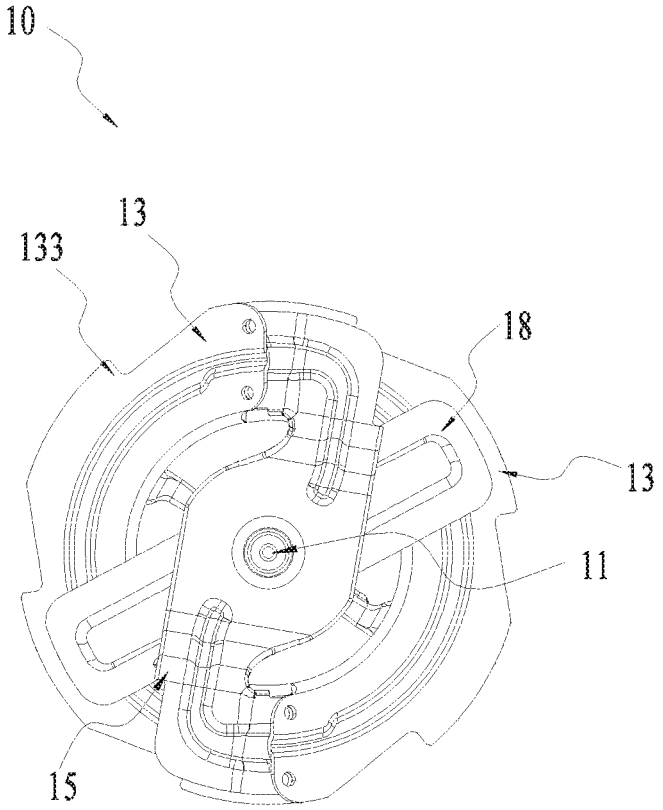
FIG. 6 is a plan view of the auger in FIG. 3 from another view angle.

As shown in FIG. 1 and FIG. 2, the example snow thrower 100 includes an auger 10, a motor, a handle 20, a chassis 30, an auger housing 40, a snow throwing member 50, wheels 60, a controlling trigger 70, and a regulating handle 80.

The auger 10 serves as the functional element of the snow thrower 100. The motor drives the auger 10 to rotate to implement a snow clearing function. The handle 20 is configured to be held by a user. The handle 20 is connected to the chassis 30. The handle 20 is rotatable relative to the chassis 30. The motor is secured to the chassis 30. The motor may be an internal combustion engine which is powered by fuel combustion, or an electric powered motor. Specifically, the motor is an electric motor. The snow thrower 100 further includes a battery pack. The battery pack powers the motor. The auger housing 40 accommodates the auger 10. The auger housing 40 is formed with an accommodating cavity 41. The auger 10 rotates in the accommodating cavity 41. The snow throwing member 50 is configured to guide the snow thrown by the auger 10. The snow throwing member 50 changes a trace of the snow to guide the snow away. The snow throwing member 50 is connected to the middle portion of the accommodating cavity 41. The snow throwing member 50 forms a throwing passage. The throwing passage is communicated with the accommodating cavity 41. The snow that enters the accommodating cavity 41 is thrown by the auger 10 into the throwing passage. The wheels 60 rotate relative to the chassis 30 so that the snow thrower 100 moves on ground. The controlling trigger 70 is operated by the user to start the motor. The regulating handle 80 is operated by the user to regulate a position of the snow throwing member 50 so that the snow can be thrown to different directions. The rotation of regulating handle 80 drives the snow throwing member 50 to rotate.

As shown in FIG. 3 to FIG. 6, the auger 10 includes a supporting shaft 11, a snow throwing bracket 12, a left snow scraper 13, a right snow scraper 14, a left supporting plate 15 and a right supporting plate 16.

The supporting shaft 11 has a central axis 101. The motor drives the supporting shaft 11 to rotate about the central axis 101. The snow throwing bracket 12 is configured to throw the snow. The position of the snow throwing bracket 12 corresponds to the position of the snow throwing member 50, so that the snow thrown by the snow throwing bracket 12 can directly enter the throwing passage. The snow throwing bracket 12 is secured to a middle portion of the supporting shaft 11.

The left snow scraper 13 is substantially helical, and surrounds the supporting shaft 11. The left snow scraper 13 is secured to a left end of the snow throwing bracket 12. The left snow scraper 13 is configured to push the snow to the right towards a region in which the snow throwing bracket 12 is located so as to facilitate the snow-throwing of the snow throwing bracket 12. Specifically, the left snow scraper 13 is formed integrally as an independent part.

The right snow scraper 14 is substantially helical, and surrounds the supporting shaft 11. The right snow scraper 14 is secured to a right end of the snow throwing bracket 12. The right snow scraper 14 is configured to push the snow to the left towards a region in which the snow throwing bracket 12 is located so as to facilitate the snow-throwing of the snow throwing bracket 12. Specifically, the right snow scraper 14 is formed integrally as an independent part. The snow is gathered from two sides to the middle by the left snow scraper 13 and the right snow scraper 14 to facilitate the throwing of the snow.

The left supporting plate 15 is secured to a left end of the supporting shaft 11. The right supporting plate 16 is secured to a right end of the supporting shaft 11. Two ends of the left snow scraper 13 are respectively secured to the snow throwing bracket 12 and the left supporting plate 15. Two ends of the right snow scraper 14 are respectively secured to the snow throwing bracket 12 and the right supporting plate 16. The left snow scraper 13 and the right snow scraper 14 are respectively secured to two ends of the snow throwing bracket 12.

The left snow scraper 13 and the right snow scraper 14 are symmetrical about a plane 102 perpendicular to the central axis 101.

In one or more embodiments, the auger 10 includes two left snow scrapers 13 and two right snow scrapers 14. The two left snow scrapers 13 are respectively secured to two ends of the left supporting plate 15. The two right snow scrapers 14 are respectively secured to two ends of the right supporting plate 16. The middle portion of the left supporting plate 15 is secured to the supporting shaft 11. The middle portion of the right supporting plate 16 is secured to the supporting shaft 11.

The snow throwing bracket 12 is made of a first material. The auger 10 further includes an edge plate 17. The edge plate 17 is secured to the snow throwing bracket 12. The edge plate 17 protrudes from an edge of the snow throwing bracket 12 in a radial direction of the central axis 101. The edge plate 17 is made of a second material which has a smaller hardness than the first material. Specifically, the snow throwing bracket 12 is made of metal material. The edge plate 17 is made of rubber material. The edge plate 17 increases a snow throwing area of the auger 10, and increases snow throwing efficiency. In addition, the arrangement of the edge plate 17 can prevent foreign matters from being caught between the snow throwing bracket 12 and a cavity wall of the accommodating cavity 41.

The edge plate 17 is formed with a snow throwing plane 17*a* for throwing snow. A side of the snow throwing plane 17*a*, away from the central axis 101, is a straight line, and the straight line is parallel to the central axis 101. Specifically, the snow throwing plane 17*a* is substantially rectangular. Specifically, a side of the edge plate 17, away from the central axis 101, is a straight edge. The auger 10 includes two edge plates 17. The two edge plates 17 are respectively secured to two ends of the snow throwing bracket 12 away from the central axis 101. The two edge plates 17 are centrally symmetrical about the central axis 101.

The auger 10 further includes bolts 171. Two bolts 171 are configured to fix the edge plates 17 and the snow throwing bracket 12. The two bolts 171 are symmetrical about the plane 102. The edge plates 17 are reliably secured.

The snow throwing bracket 12 is provided with a through hole 121. The through hole 121 is located between the edge plates 17 and the supporting shaft 11. A linear velocity of part of the snow throwing bracket 12 close to the supporting shaft 11 is low during rotation, thereby possibly causing low snow throwing height and leading to snow scattering. The arrangement of the through hole 121 prevents the part of the snow throwing bracket 12 close to the supporting shaft 11 from throwing snow and improves snow throwing quality.

Sawteeth 133 are formed at an outer side of the left snow scraper 13 away from the central axis 101. The left snow scraper 13 and the right snow scraper 14 have the same structure. The left snow scraper 13 and the right snow scraper 14 can perform cutting during rotation and break hard snow blocks or ice blocks, thereby increasing the snow clearing efficiency.

Hardness of the left snow scraper 13 and hardness of the right snow scraper 14 are greater than or equal to 50 HRB and less than or equal to 100 HRB. Thickness of the left snow scraper 13 and thickness of the right snow scraper 14 are greater than or equal to 1.5 mm and less than or equal to 3.5 mm. The setting of the strength and the thickness of the left snow scraper 13 and the right snow scraper 14 not only ensures the strength of the left snow scraper 13 and the right snow scraper 14, but also improves the capability of the left snow scraper 13 and the right snow scraper 14 for breaking the hard snow blocks or ice blocks, and increases the snow clearing efficiency. As a specific example, the left snow scraper 13 and the right snow scraper 14 are made of metal material.

Figure 7:
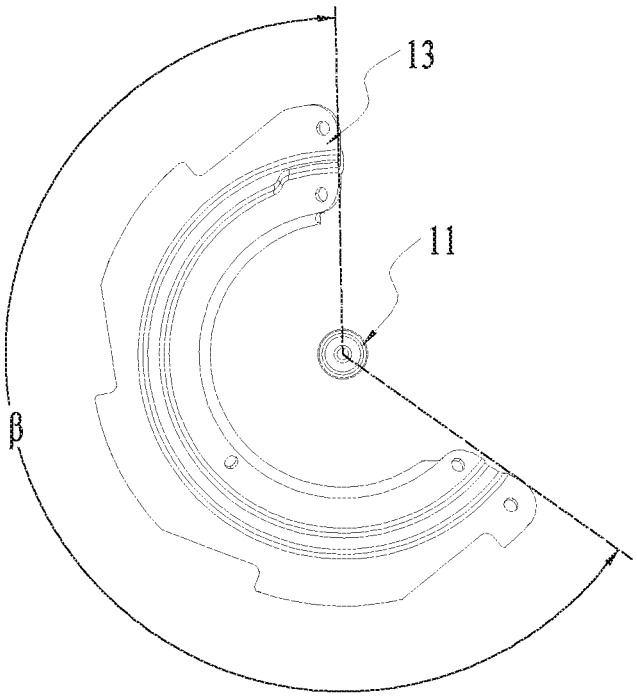
FIG. 7 is a schematic diagram illustrating a left snow scraper around a supporting shaft of the auger in FIG. 3.
Figure 8:
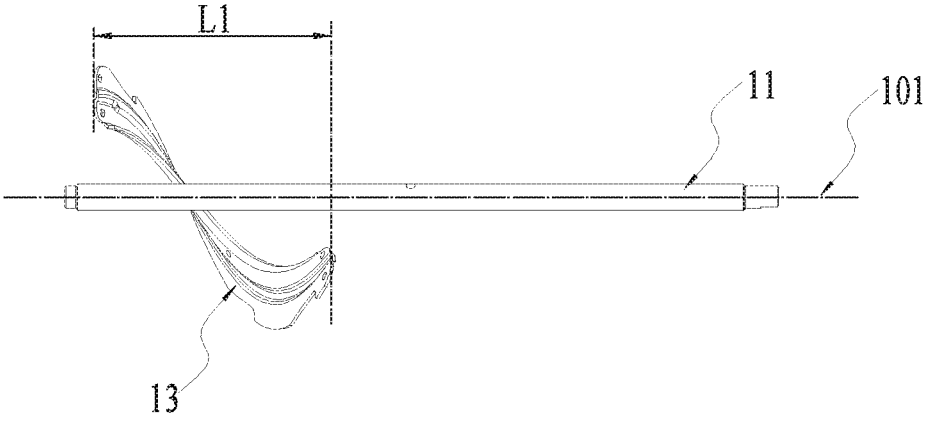
FIG. 8 is a schematic diagram illustrating the left snow scraper around the supporting shaft of the auger in FIG. 3 from another view angle.

As shown in FIG. 7 and FIG. 8, an angle β of the left snow scraper 13 around the central axis 101 is greater than 180 degrees and smaller than 360 degrees. A length L1 of the left snow scraper 13 in the direction of the central axis 101 is greater than or equal to 120 mm and less than or equal to 200 mm. A ratio of the angle β of the left snow scraper 13 around the central axis 101 to the length L1 of the left snow scraper 13 in the direction of the central axis 101 is greater than or equal to 0.9 degree/mm and less than or equal to 3 degree/mm.

Specifically, the angle β of the left snow scraper 13 around the central axis 101 is greater than 210 degrees and smaller than 270 degrees. The ratio of the angle β of the left snow scraper 13 around the central axis 101 to the length L1 of the left snow scraper 13 in the direction of the central axis 101 is greater than or equal to 1 degree/mm and less than or equal to 2.2 degree/mm.

In the direction of the central axis 101, the left snow scraper 13 has a high snow conveying capability, and can rapidly guide the snow which contacts the left snow scraper 13 to a region corresponding to the snow throwing bracket 12, thereby increasing the snow sweeping efficiency.

As shown in FIG. 3 to FIG. 6, the auger 10 further includes a left auxiliary supporting plate 18 located between the snow throwing bracket 12 and the left supporting plate 15. The middle portion of the left snow scraper 13 is secured to an end of the left auxiliary supporting plate 18. The middle portion of the left auxiliary supporting plate 18 is secured to the supporting shaft 11. Two ends of the left auxiliary supporting plate 18 are respectively secured to the middle portions of the two left snow scrapers 13. The left auxiliary supporting plate 18 supports the left snow scrapers 13 and enhances the strength of the left snow scrapers 13.

The auger 10 further includes a right auxiliary supporting plate 19 located between the snow throwing bracket 12 and the right supporting plate 16. The middle portion of the right supporting plate 19 is secured to the supporting shaft 11. Two ends of the right auxiliary supporting plate 19 are respectively secured to the middle portions of the two right snow scrapers 14.

A side of the left snow scraper 13, which faces the snow throwing bracket 12, is defined as a front side of the left snow scraper 13, and a side of the left snow scraper 13, which faces away from the snow throwing bracket 12, is defined as a rear side of the left snow scraper 13. The left snow scraper 13 is provided with a protruding rib 131 protruding from the front side of the left snow scraper 13, and the protruding rib 131 is located in the middle portion of the left snow scraper 13. The rear side of the left snow scraper 13 is provided with a groove 132 corresponding to the protruding rib 131. The left snow scraper 13 has a high strength. The left snow scraper 13 and the right snow scraper 14 are symmetrical about the plane 102. The left snow scraper 13 and the right snow scraper 14 have the same structure.

The above shows and describes basic principles, major features and advantages of the present disclosure. Those skilled in the art should understand that above embodiments do not limit the present disclosure in any form. Technical solutions obtained by equivalent substitutions or equivalent transformations fall within a protection scope of the present disclosure.

What is claimed is:

1. An auger for use in a snow thrower, said auger comprising:

a supporting shaft having a central axis;

a snow throwing bracket secured to a middle portion of the supporting shaft and configured to throw snow;

a left snow scraper surrounding the supporting shaft, secured to a left end of the snow throwing bracket and configured to push snow to the right towards a region where the snow throwing bracket is located;

a right snow scraper surrounding the supporting shaft, secured to a right end of the snow throwing bracket and configured to push snow to the left towards the region where the snow throwing bracket is located;

a left supporting plate secured to a left end of the supporting shaft, wherein two ends of the left snow scraper are respectively secured to the snow throwing bracket and the left supporting plate;

a right supporting plate secured to a right end of the supporting shaft, wherein two ends of the right snow scraper are respectively secured to the snow throwing bracket and the right supporting plate;

a left auxiliary supporting plate provided separately from the snow throwing bracket to form a first gap between the left auxiliary supporting plate and the snow throwing bracket in a direction of the central axis, wherein the left auxiliary supporting plate is arranged separately from the left supporting plate to form a second gap between the left auxiliary supporting plate and the left supporting plate in the direction of the central axis, and the left auxiliary supporting plate is located between the snow throwing bracket and the left supporting plate; and a right auxiliary supporting plate provided separately from the snow throwing bracket to form a third gap between the right auxiliary supporting plate and the snow throwing bracket in the direction of the central axis, wherein the right auxiliary supporting plate is arranged separately from the right supporting plate to form a forth gap between the right auxiliary supporting plate and the right supporting plate in the direction of the central axis, and the right auxiliary supporting plate is located between the snow throwing bracket and the right supporting plate, wherein the left snow scraper and the right snow scraper are symmetrical about a plane perpendicular to the central axis, an angle of the left snow scraper around the central axis is greater than 180 degrees and smaller than 360 degrees, and a ratio of the angle of the left snow scraper around the central axis to a length of the left snow scraper in a direction of the central axis is greater than or equal to 0.9 degree/mm and less than or equal to 3 degree/mm, and wherein the left auxiliary supporting plate is secured to the supporting shaft, a middle portion of the left snow scraper is secured to an end of the left auxiliary supporting plate, the right auxiliary supporting plate is secured to the supporting shaft, and a middle portion of the right snow scraper is secured to an end of the right auxiliary supporting plate.

2. The auger according to claim 1, wherein the angle of the left snow scraper around the central axis is greater than 210 degrees and smaller than 270 degrees and the ratio of the angle of the left snow scraper around the central axis to the length of the left snow scraper in the direction of the central axis is greater than or equal to 1 degree/mm and less than or equal to 2.2 degree/mm.

3. The auger according to claim 1, wherein the auger comprises two left snow scrapers and two right snow scrapers, the two left snow scrapers are respectively secured to two ends of the left supporting plate, and the two right snow scrapers are respectively secured to two ends of the right supporting plate.

4. The auger according to claim 1, wherein the snow throwing bracket is made of a first material, the auger further comprises an edge plate made of a second material having a smaller hardness than the first material, the edge plate is secured to an edge of the snow throwing bracket, and the edge plate protrudes from the edge of the snow throwing bracket in a radial direction of the central axis.

5. The auger according to claim 4, wherein the snow throwing bracket is provided with a through hole and the through hole is located between the edge plate and the supporting shaft.

6. The auger according to claim 1, wherein a hardness of the left snow scraper is greater than or equal to 50 HRB and less than or equal to 100 HRB and a thickness of the left snow scraper is greater than or equal to 1.5 mm and less than or equal to 3.5 mm.

7. The auger according to claim 1, wherein an outer side of the left snow scraper away from the central axis is provided with sawteeth.

8. The auger according to claim 1, wherein the left snow scraper is provided with a protruding rib protruding from a surface of the left snow scraper facing the snow throwing bracket and the rear side of the left snow scraper is provided with a groove corresponding to the protruding rib.

9. The auger according to claim 1, wherein the auger is made of a metal material.

10. The auger according to claim 1, and wherein the auger comprises two left snow scrapers and the left auxiliary supporting plate connects two left snow scrapers between the snow throwing bracket and the left supporting plate.

11. A snow thrower, comprising:

a auger housing formed with an accommodating cavity; and an auger arranged in the accommodating cavity;

wherein the auger comprises:

a supporting shaft having a central axis;

a snow throwing bracket secured to a middle portion of the supporting shaft and configured to throw snow;

a left snow scraper surrounding the supporting shaft, secured to a left end of the snow throwing bracket and configured to push snow to the right towards a region where the snow throwing bracket is located;

a right snow scraper surrounding the supporting shaft, secured to a right end of the snow throwing bracket and configured to push snow to the left towards the region where the snow throwing bracket is located;

a left supporting plate secured to a left end of the supporting shaft, wherein two ends of the left snow scraper are respectively secured to the snow throwing bracket and the left supporting plate;

a right supporting plate secured to a right end of the supporting shaft, wherein two ends of the right snow scraper are respectively secured to the snow throwing bracket and the right supporting plate;

a left auxiliary supporting plate provided separately from the snow throwing bracket to form a first gap between the left auxiliary supporting plate and the snow throwing bracket in a direction of the central axis, wherein the left auxiliary supporting plate is arranged separately from the left supporting plate to form a second gap between the left auxiliary supporting plate and the left supporting plate in the direction of the central axis, and the left auxiliary supporting plate is located between the snow throwing bracket and the left supporting plate; and a right auxiliary supporting plate provided separately from the snow throwing bracket to form a third gap between the right auxiliary supporting plate and the snow throwing bracket in the direction of the central axis, wherein the right auxiliary supporting plate is arranged separately from the right supporting plate to form a forth gap between the right auxiliary supporting plate and the right supporting plate in the direction of the central axis, and the right auxiliary supporting plate is located between the snow throwing bracket and the right supporting plate, wherein the left snow scraper and the right snow scraper are symmetrical about a plane perpendicular to the central axis, an angle of the left snow scraper around the central axis is greater than 180 degrees and smaller than 360 degrees, and a ratio of the angle of the left snow scraper around the central axis to a length of the left snow scraper in a direction of the central axis is greater than or equal to 0.9 degree/mm and less than or equal to 3 degree/mm, and wherein the left auxiliary supporting plate is secured to the supporting shaft, a middle portion of the left snow scraper is secured to an end of the left auxiliary supporting plate, the right auxiliary supporting plate is secured to the supporting shaft, and a middle portion of the right snow scraper is secured to an end of the right auxiliary supporting plate.

12. The snow thrower according to claim 11, wherein the auger comprises two left snow scrapers and two right snow scrapers, the two left snow scrapers are respectively secured to two ends of the left supporting plate, and the two right snow scrapers are respectively secured to two ends of the right supporting plate.

13. The snow thrower according to claim 11, wherein the snow throwing bracket is made of a first material, the auger further comprises an edge plate made of a second material having a smaller hardness than the first material, the edge plate is secured to an edge of the snow throwing bracket, and the edge plate protrudes from the edge of the snow throwing bracket in a radial direction of the central axis.

14. The snow thrower according to claim 13, wherein the snow throwing bracket is provided with a through hole and the through hole is located between the edge plate and the supporting shaft.

15. The snow thrower according to claim 11, wherein an outer side of the left snow scraper away from the central axis is provided with sawteeth.

16. The snow thrower according to claim 11, wherein the left snow scraper is provided with a protruding rib protruding from a surface of the left snow scraper facing the snow throwing bracket and the rear side of the left snow scraper is provided with a groove corresponding to the protruding rib.

17. The snow thrower according to claim 11, wherein the auger is made of a metal material.

18. The snow thrower according to claim 11, wherein the auger comprises two left snow scrapers and the left auxiliary supporting plate connects two left snow scrapers between the snow throwing bracket and the left supporting plate.

* * * * *